US008557497B2

(12) United States Patent
Watanabe et al.

(10) Patent No.: US 8,557,497 B2
(45) **Date of Patent: *Oct. 15, 2013**

(54) METHOD OF MANUFACTURING TONER AND TONER

(75) Inventors: Junichi Watanabe, Shizuoka (JP); Kenichi Uehara, Shizuoka (JP); Junya Koeda, Shizuoka (JP); Daisuke Misawa, Shizuoka (JP); Keisuke Tada, Shizuoka (JP); Miyuki Hirata, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 183 days.

This patent is subject to a terminal disclaimer.

(21) Appl. No.: 12/960,943

(22) Filed: Dec. 6, 2010

(65) Prior Publication Data

US 2011/0136052 A1 Jun. 9, 2011

(30) Foreign Application Priority Data

Dec. 9, 2009 (JP) ..... 2009-279821

(51) Int. Cl.
*G03G 5/00* (2006.01)

(52) U.S. Cl.
USPC ..... 430/137.17; 430/137.1; 430/137.15; 430/137.22

(58) Field of Classification Search
USPC ..... 430/137.1, 137.15, 137.17, 137.22
See application file for complete search history.

(56) References Cited

U.S. PATENT DOCUMENTS

| | | | | |
|---|---|---|---|---|
| 2008/0311504 | A1 | 12/2008 | Hattori et al. | |
| 2011/0033796 | A1* | 2/2011 | Yamada et al. | 430/113 |
| 2011/0086305 | A1* | 4/2011 | Watanabe et al. | 430/108.1 |

FOREIGN PATENT DOCUMENTS

| | | |
|---|---|---|
| JP | 2006-227592 | 8/2006 |
| JP | 2009-150954 | 7/2009 |
| JP | 4364812 | 8/2009 |

* cited by examiner

*Primary Examiner* — Mark F Huff
*Assistant Examiner* — Stewart Fraser
(74) *Attorney, Agent, or Firm* — Oblon, Spivak, McClelland, Maier & Neustadt, L.L.P.

(57) ABSTRACT

A method of manufacturing toner including preparing a first liquid by dissolving or dispersing toner components including one or both of a binder resin and a precursor thereof in an organic solvent; preparing a second liquid by dispersing the first liquid in a first aqueous medium including a dispersant; producing primary particles by removing the organic solvent from the second liquid; washing the primary particles; preparing a third liquid by dispersing the washed primary particles in a second aqueous medium and heating the second aqueous medium while or after dispersing the washed primary particles therein; and producing toner particles by adding a charge controlling agent to the third liquid. This method satisfies the following inequation:

$$0.60 \leq Sb/Sa \leq 1.00$$

wherein Sa represents a BET specific surface area of the primary particles included in the third liquid and Sb represents that of the toner particles stored for 2 weeks at 40° C., 70% RH.

11 Claims, No Drawings

METHOD OF MANUFACTURING TONER AND TONER

CROSS-REFERENCE TO RELATED APPLICATIONS

The present patent application claims priority pursuant to 35 U.S.C. §119 from Japanese Patent Application No. 2009-279821, filed on Dec. 9, 2009, which is hereby incorporated by reference herein in its entirety.

BACKGROUND

1. Field of the Invention

The present invention relates to a method of manufacturing toner and a toner.

2. Description of the Background

A number of electrophotographic image forming apparatuses are equipped with a replaceable process cartridge. In accordance with increase in image printing speed, the process cartridge is now getting larger, which is against recent demand for downsizing or installation space reduction. To meet such demand, for example, the process cartridge is preferably filled with toner particles which can be packed at a high density. Such toner particles can be obtained by controlling toner shape or chargeability. From the viewpoint of toner shape, spherical toner particles having a smoother surface can be packed at a higher density. From the viewpoint of chargeability, toner particles having a lower charge can be packed at a higher density because such toner particles do not repel each other.

Japanese Patent Application Publication No. 2006-227592 discloses a toner obtained through processes of granulation in an aqueous medium, washing, and drying. When this toner is dispersed in an aqueous medium having a temperature above the glass transition temperature of the toner, the aqueous medium expresses a specific conductivity of 60 μS/cm. This indicates that residual surfactants remain on the toner surface in a very small amount, and therefore the toner has relatively a smooth surface.

However, when this toner is exposed to a high-temperature and high-humidity atmosphere while stored or transported, the chargeability thereof may considerably deteriorate.

SUMMARY

Exemplary aspects of the present invention are put forward in view of the above-described circumstances, and provide a novel method of manufacturing a toner which keeps good chargeability even when exposed to high-temperature and high-humidity conditions.

In one exemplary embodiment, a novel method of manufacturing toner includes preparing a first liquid by dissolving or dispersing toner components including one or both of a binder resin and a precursor thereof in an organic solvent; preparing a second liquid by dispersing the first liquid in a first aqueous medium including a dispersant; producing primary particles by removing the organic solvent from the second liquid; washing the primary particles; preparing a third liquid by dispersing the washed primary particles in a second aqueous medium and heating the second aqueous medium while or after dispersing the washed primary particles therein; and producing toner particles by adding a charge controlling agent to the third liquid. This method satisfies the following inequation:

$$0.60 \leq Sb/Sa \leq 1.00$$

wherein Sa represents a BET specific surface area of the primary particles included in the third liquid and Sb represents a BET specific surface area of the toner particles stored for 2 weeks at 40° C., 70% RH.

In another exemplary embodiment, a novel toner includes a binder resin and a charge controlling agent, and satisfies the following inequation:

$$0.60 \leq Sb/Sa \leq 1.00$$

wherein Sa represents a BET specific surface area of the toner and Sb represents a BET specific surface area of the toner stored for 2 weeks at 40° C., 70% RH.

DETAILED DESCRIPTION

An exemplary aspect of the present invention provides a method of manufacturing toner including preparing a first liquid by dissolving or dispersing toner components including one or both of a binder resin and a precursor thereof in an organic solvent; preparing a second liquid by dispersing the first liquid in a first aqueous medium including a dispersant; producing primary particles by removing the organic solvent from the second liquid; washing the primary particles; preparing a third liquid by dispersing the washed primary particles in a second aqueous medium and heating the second aqueous medium while or after dispersing the washed primary particles therein; and producing toner particles by adding a charge controlling agent to the third liquid. This method satisfies the inequation $0.60 \leq Sb/Sa \leq 1.00$, preferably $0.80 \leq Sb/Sa \leq 1.00$, wherein Sa represents a BET specific surface area of the primary particles included in the third liquid and Sb represents a BET specific surface area of the toner particles stored for 2 weeks at 40° C., 70% RH.

The above inequation indicates that the dispersant has been removed from the surfaces of the primary particles by the washing, and micro irregularities existing on their surfaces are effectively reduced, in other words, the surfaces are smoothened, by the heating. Upon heating, the primary particles soften and reduce the micro irregularities so as to reduce their surface free energy. If the primary particles are heated without removing the dispersant, the primary particles do not reduce the micro irregularities because the dispersant inherently has a low surface free energy.

Because such primary particles having been washed and heated have few micro irregularities, the resulting toner do not further alter their surface conditions, in other words, do not reduce their surface areas, even when exposed to high-temperature and high-humidity conditions. Accordingly, the resulting toner particles do not degrade their chargeability even when exposed to high-temperature and high-humidity conditions.

When Sb/Sa is too small, it indicates that the micro irregularities have not been sufficiently reduced by the washing and heating. Such primary particles having the micro irregularities on their surface result in toner particles which degrade chargeability when exposed to high-temperature and high-humidity conditions.

It is difficult to manufacture toner particles satisfying $Sb/Sa < 1.00$.

In a case in which the second liquid containing the primary particles is heated, the primary particles do not reduce micro irregularities existing on their surfaces because the dispersant is not removed and still remaining thereon. Such primary particles disadvantageously result in toner particles which degrade chargeability when exposed to high-temperature and high-humidity conditions.

In another case in which the third liquid containing the toner particles having a charge controlling agent on their surface is heated, the charge controlling agent is eluted, thus degrading chargeability of the toner particles.

When preparing the third liquid, the second aqueous medium is preferably heated to 40 to 70° C., more preferably 40 to 65° C. When the heating temperature is too low, the micro irregularities may not be sufficiently reduced, resulting in toner particles which degrade chargeability when exposed to high-temperature and high-humidity conditions. When the heating temperature is too high, the primary particles may disadvantageously adhere to a heat exchanger in use.

To achieve the inequation $0.60 \leq Sb/Sa \leq 1.00$, the heating time is preferably 5 minutes to 2 hours.

The first liquid preferably has an acid value of from 2 to 30 KOHmg/g. When the acid value is too small, the resulting toner particles may have poor adhesiveness to paper. When the acid value is too large, the resulting toner particles may have a wide size distribution.

Acid value can be measured based on a method according to JIS K0070-1992.

Specific preferred examples of suitable binder resins include, but are not limited to, polyester, styrene homopolymers (e.g., polystyrene, poly(p-chlorostyrene), polyvinyl toluene), styrene copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), methacrylate homopolymers (e.g., polymethyl methacrylate, polybutyl methacrylate), vinyl homopolymers (e.g., polyvinyl chloride, polyvinyl acetate, polyethylene, polypropylene), epoxy resins, epoxy polyol resins, polyurethane, polyamide, polyvinyl butyral, polyacrylic resins, rosin, modified rosin, terpene resins, aliphatic or alicyclic hydrocarbon resins, and aromatic petroleum resins. Two or more of these resins can be used in combination. From the view point of low-temperature fixability of the resulting toner, polyester is preferable.

A polyester can be obtained by polycondensation between a polyol and a polycarboxylic acid. For example, a polyester can be obtained by heating a polyol and a polycarboxylic acid to 150 to 280° C. in the presence of a catalyst (e.g., tetrabutoxy titanate, dibutyltin oxide), while optionally reducing pressure, and removing the produced water.

Specific examples of usable polyols include, but are not limited to, divalent alcohols (e.g., ethylene glycol, diethylene glycol, triethylene glycol, propylene glycol, 1,4-bis(hydroxymethyl)cyclohexane, bisphenol A) and polyvalent alcohols having 3 or more valences. Two or more of these polyols can be used in combination.

Specific examples of usable polycarboxylic acids include, but are not limited to, divalent carboxylic acids (e.g., maleic acid, fumaric acid, phthalic acid, isophthalic acid, terephthalic acid, succinic acid, malonic acid) and polyvalent carboxylic acids having 3 or more valences (e.g., 1,2,4-benzenetricarboxyluc acid, 1,2,5-benzenetricarboxylic acid, 1,2,4-hexanetricarboxylic acid, 1,2,4-naphthalenetricarboxylic acid, 1,2,5-hexanetricarboxylic acid, 1,3-dicarboxyl-2-methylenecarboxylpropane, 1,2,7,8-octanetetracarboxyluc acid). Two or more of these polycarboxylic acids can be used in combination.

Specific preferred examples of suitable precursors of binder resins include, but are not limited to, styrene monomers (e.g., styrene, α-methylstyrene, p-methylstyrene, p-chlorostyrene), nitrile monomers (e.g., acrylonitrile), acrylate or methacrylate monomers (e.g., methyl acrylate, methyl methacrylate, ethyl acrylate, ethyl methacrylate, butyl acrylate, butyl methacrylate, ethylhexyl acrylate, ethylhexyl methacrylate, lauryl acrylate, lauryl methacrylate, stearyl acrylate, stearyl methacrylate), and conjugated diene monomers (e.g., butadiene, isoprene). Two or more of these monomers can be used in combination. Additionally, prepolymers having a functional group reactive with an active hydrogen group are preferable.

The prepolymer having a functional group reactive with an active hydrogen group reacts with a compound having an active hydrogen group while the organic solvent is removed from the second liquid.

The compound having an active hydrogen group may be previously included in either the first liquid or the first aqueous medium including a dispersant. Alternatively, the compound may be added to the first aqueous medium while or after the first liquid is dispersed therein.

The active hydrogen group may be, for example, a hydroxyl group (e.g., an alcoholic hydroxyl group, a phenolic hydroxyl group), an amino group, a carboxyl group, or a mercapto group. Two or more of these active hydrogen groups can be simultaneously included in the compound. Among these hydroxyl groups, amino groups are preferable because they are reactive with a polyester prepolymer having an isocyanate group to produce an urea-modified polyester.

The prepolymer having a functional group reactive with an active hydrogen group may be, for example, a polyester, a polyol resin, an acrylic resin, or an epoxy resin, each of which has an isocyanate group, an epoxy group, a carboxyl group, or a chlorocarbonyl group. Two or more of these materials can be used in combination. Among these materials, polyester prepolymers having an isocyanate group are preferable because they are reactive with a compound having an amino group to produce an urea-modified polyester.

The polyester prepolymer having an isocyanate group can be obtained by reacting a polyester having a hydroxyl group with a polyisocyanate at 40 to 140° C., in the presence of an organic solvent, if needed.

The organic solvent is inactive with the polyisocyanate. Specific examples of such organic solvents include, but are not limited to, aromatic solvents (e.g., toluene, xylene), ketones (e.g., acetone, methyl ethyl ketone, methyl isobutyl ketone), esters (e.g., ethyl acetate), amides (e.g., dimethylformamide, dimethylacetamide), and ethers (e.g., tetrahydrofuran). Two or more of these solvents can be used in combination.

The polyester having a hydroxyl group can be obtained by polycondensation between a polyol and a polycarboxylic acid.

The polyol may be, for example, a divalent alcohol, a polyvalent alcohol having 3 or more valences, or a mixture of a divalent alcohol and a polyvalent alcohol having 3 or more valences. Two or more polyols can be used in combination. Among these polyols, a mixture of a divalent alcohol and a polyvalent alcohol having 3 or more valences is preferable.

Specific examples of the divalent alcohol include, but are not limited to, alkylene glycols (e.g., ethylene glycol, 1,2-propylene glycol, 1,3-propylene glycol, 1,4-butanediol, 1,6-hexanediol), polyalkylene glycols (e.g., diethylene glycol, triethylene glycol, dipropylene glycol, polyethylene glycol, polypropylene glycol, polybutylene glycol), alicyclic diols (e.g., 1,4-cyclohexanedimethanol, hydrogenated bisphenol A), alkylene oxide (e.g., ethylene oxide, propylene oxide, butylene oxide) adducts of alicyclic diols, bisphenols (e.g., bisphenol A, bisphenol F, bisphenol S), and alkylene oxide (e.g., ethylene oxide, propylene oxide, butylene oxide) adducts of bisphenols. Among the above divalent alcohols, alkylene glycols having 2 to 12 carbon atoms and alkylene oxide adducts of bisphenols are preferable; and alkylene oxide adducts of bisphenols and mixtures of an alkylene oxide adducts of bisphenol with an alkylene glycol having 2 to 12 carbon atoms are more preferable.

Specific examples of the polyvalent alcohol having 3 or more valences include, but are not limited to, polyvalent aliphatic alcohols (e.g., glycerin, trimethylolethane, trimethylolpropane, pentaerythritol, sorbitol), polyphenols (e.g., trisphenol PA (from Honshu Chemical Industry Co., Ltd.), phenol novolac, cresol novolac), and alkylene oxide (e.g., ethylene oxide, propylene oxide, butylene oxide) adducts of polyphenols.

The polycarboxylic acid may be, for example, a divalent carboxylic acid, a polyvalent carboxylic acid having 3 or more valences, or a mixture of a divalent carboxylic acid and a polyvalent carboxylic acid having 3 or more valences. Two or more polycarboxylic acids can be used in combination. Among these polycarboxylic acids, a mixture of a divalent carboxylic acid and a polyvalent carboxylic acid having 3 or more valences is preferable.

Specific examples of the divalent carboxylic acid include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acids (e.g., phthalic acid, isophthalic acid, terephthalic acid, naphthalenedicarboxylic acid). Among these divalent carboxylic acids, alkenylene dicarboxylic acids having 4 to 20 carbon atoms and aromatic dicarboxylic acids having 8 to 20 carbon atoms are preferable.

Specific examples of the polyvalent carboxylic acid having 3 or more valences include, but are not limited to, polyvalent aromatic carboxylic acids (e.g., trimellitic acid, pyromellitic acid). Among these polyvalent carboxylic acids, polyvalent aromatic carboxylic acids having 9 to 20 carbon atoms are preferable.

Additionally, anhydrides and lower alkyl esters (e.g., methyl ester, ethyl ester, isopropyl ester) of polycarboxylic acids are also usable as the polycarboxylic acid.

When preparing the polyester having a hydroxyl group, the equivalent ratio of hydroxyl groups in the polyol to carboxyl groups in the polycarboxylic acid is preferably from 1 to 2, more preferably from 1 to 1.5, and most preferably from 1.02 to 1.3.

Specific examples of suitable polyisocyanates include, but are not limited to, aliphatic polyisocyanates (e.g., tetramethylene diisocyanate, hexamethylene diisocyanate, 2,6-diisocyanatomethyl caproate, octamethylene diisocyanate, decamethylene diisocyanate, dodecamethylene diisocyanate, tetradecamethylene diisocyanate, trimethylhexane diisocyanate, tetramethylhexane diisocyanate), alicyclic polyisocyanates (e.g., isophorone diisocyanate, cyclohexylmethane diisocyanate), aromatic diisocyanates (e.g., tolylene diisocyanate, diphenylmethane diisocyanate, 1,5-naphtylene diisocyanate, diphenylene-4,4'-diisocyanate, 4,4'-diisocyanato-3,3'-dimethyldiphenyl, 3-methyldiphenylmethane-4,4'-diisocyanate, diphenyl ether-4,4'-diisocyanate), aromatic aliphatic diisocyanates (e.g., $\alpha,\alpha,\alpha',\alpha'$-tetramethylxylylene diisocyanate), and isocyanurates (e.g., tris(isocyanatoalkyl) isocyanurate, triisocyanatocycloalkyl isocyanurate).

Additionally, polyisocyanates in which the isocyanate group is blocked with a phenol derivative, an oxime, or caprolactam are also usable as the polyisocyanate.

When preparing the polyester prepolymer having an isocyanate group, the equivalent ratio of isocyanate groups in the polyisocyanate to hydroxyl groups in the polyester having a hydroxyl group is preferably from 1 to 5, more preferably from 1.2 to 4, and most preferably from 1.5 to 2.5.

The polyester prepolymer having an isocyanate group preferably includes polyisocyanate-origin units in an amount of from 0.5 to 40% by weight, more preferably from 1 to 30% by weight, and most preferably from 2 to 20% by weight.

The compound having an amino group may be, for example, a diamine, an amine having 3 or more valences, an amino alcohol, an amino mercaptan, or an amino acid. Two or more of these compounds can be used in combination. Among these compounds, a diamine, and a mixture of a diamine with a small amount of an amine having 3 or more valences are preferable.

Specific examples of usable diamines include, but are not limited to, aromatic diamines (e.g., phenylenediamine, diethyltoluenediamine, 4,4'-diaminophenylmethane), alicyclic diamines (e.g., 4,4'-diamino-3,3'-dimethyldicyclohexylmethane, diaminecyclohexane, isophoronediamine), and aliphatic diamines (e.g., ethylenediamine, tetramethylenediamine, hexamethylenediamine).

Specific examples of usable amines having 3 or more valences include, but are not limited to, diethylenetriamine and triethylenetetramine.

Specific examples of usable amino alcohols include, but are not limited to, ethanolamine and hydroxyethylaniline.

Specific examples of usable amino mercaptans include, but are not limited to, aminoethyl mercaptan and aminopropyl mercaptan.

Specific examples of usable amino acids include, but are not limited to, aminopropionic acid and amino caproic acid.

Additionally, compounds in which an amino group is blocked with a ketimine or an oxazoline are also usable as the compound having an amino group.

When reacting the polyester prepolymer having an isocyanate group with the compound having an amino group, the equivalent ratio of isocyanate groups in the polyester prepolymer to amino groups in the compound having an amino group is preferably from 0.5 to 2, more preferably from 2/3 to 1.5, and most preferably from 5/6 to 1.2.

The polyester prepolymer having an isocyanate group may react with the compound having an amino group in the presence of a catalyst (e.g. dibutyltin laurate, dioctyltin laurate), if needed.

Preferably, the polyester prepolymer having an isocyanate group reacts with the compound having an amino group at a temperature of from 0 to 150° C., more preferably from 40 to 98° C.

Preferably, the polyester prepolymer having an isocyanate group reacts with the compound having an amino group for a period of from 10 minutes to 40 hours, more preferably from 2 to 24 hours.

The reaction between the polyester prepolymer having an isocyanate group and the compound having an amino group may be terminated with a reaction terminator for the purpose of controlling the molecular weight of the resulting urea-modified polyester.

Specific preferred examples of suitable reaction terminators include, but are not limited to, monoamines (e.g., diethylamine, dibutylamine, butylamine, laurylamine) and those in which the amino group is blocked (e.g., ketimine, oxazoline).

The binder resin may also include an urea-modified polyester. An urea-modified polyester can be obtained by reacting a polyester prepolymer having an isocyanate group with a compound having an amino group at 0 to 140° C., in the presence of an organic solvent, if needed.

The organic solvent is inactive with the isocyanate group. Specific preferred examples of such organic solvents include, but are not limited to, aromatic compounds (e.g., toluene, xylene), ketones (e.g., acetone, methyl ethyl ketone, methyl isobutyl ketone), esters (e.g., ethyl acetate), amides (e.g., dimethylformamide, dimethylacetamide), and ethers (e.g., tetrahydrofuran). Two or more of these solvents can be used in combination.

The toner components may further include a colorant and/or a release agent.

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination.

The content of the colorant in the toner is preferably from 1 to 15% by weight, more preferably from 3 to 10% by weight. When the content of the colorant is too small, the toner may have poor coloring power. When the content of the colorant is too large, the colorant may not be finely dispersed in the toner. As a result, the toner has poor coloring power and electric properties.

The colorant can be combined with a resin to be used as a master batch. Specific examples of suitable resin for the master batch include, but are not limited to, polyester, styrene homopolymers (e.g., polystyrene, poly-p-chlorostyrene, polyvinyl toluene), styrene copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), methacrylic homopolymers (e.g., polymethyl methacrylate, polybutyl methacrylate), vinyl homopolymers (e.g., polyvinyl chloride, polyvinyl acetate, polyethylene, polypropylene), epoxy resins, epoxy polyol resins, polyurethane, polyamide, polyvinyl butyral, polyacrylic acids, rosin, modified rosin, terpene resins, aliphatic or alicyclic hydrocarbon resins, aromatic petroleum resin, chlorinated paraffin, and paraffin wax. Two or more of such resins can be used in combination.

The master batch can be prepared by mixing one or more of the resins as mentioned above and the colorant as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed, can be preferably used because the resultant wet cake can be used as it is without being dried. When performing the mixing and kneading processes, dispersing devices capable of applying a high shearing force such as three roll mills can be preferably used.

Specific examples of usable release agents include, but are not limited to, polyolefin waxes (e.g., polyethylene wax, polypropylene wax), long-chain hydrocarbons (e.g., paraffin wax, SAZOL wax), and waxes having a carbonyl group. Two or more of these release agents can be used in combination. Among these compounds, waxes having a carbonyl group are preferable.

Specific examples of usable waxes having a carbonyl group include, but are not limited to, carnauba wax, montan wax, polyalkanoic acid esters (e.g., trimethylolpropane tribehenate, pentaerythritol tetrabehenate, pentaerythritol diacetate dibehenate, glycerin tribehenate, 1,18-octadecanediol distearate), polyalkanol esters (e.g., trimellitic tristearyl, maleic distearyl), polyalkanoic acid amides (e.g., ethylenediamine dibehenylamide), polyalkylamides (e.g., trimellitic tristearylamide), and dialkyl ketones (e.g., distearyl ketone). Among these waxes, polyalkanoic acid esters are preferable.

The release agent preferably has a melting point of from 40 to 160° C., more preferably from 50 to 120° C., and most preferably from 60 to 90° C. When the melting point is too low, heat-resistant storage stability of the toner may be poor. When the melting point is too high, cold offset may occur when the toner is fixed at low temperatures.

The release agent preferably has a melt viscosity of from 5 to 1,000 cps, more preferably from 10 to 100 cps, at a temperature 20° C. higher than the melting point. When the melt viscosity at a temperature 20° C. higher than the melting point is too high, hot offset resistance and low-temperature fixability of the toner may be poor.

The content of the release agent in the toner is preferably from 0 to 40% by weight, and more preferably from 3 to 30% by weight.

The first liquid includes an organic solvent which dissolves the binder resin and/or the precursor thereof. Specific preferred examples of such organic solvents include, but are not limited to, aromatic solvents (e.g., toluene, xylene), ketones (e.g., acetone, methyl ethyl ketone, methyl isobutyl ketone), esters (e.g., ethyl acetate), amides 8 e.g., dimethylformamide, dimethylacetamide), and ethers (e.g., tetrahydrofuran). Two or more of these solvents can be used in combination.

When the toner components include the precursor of the binder resin, the organic solvent is required to be inactive with the precursor.

The first liquid droplets in the second liquid preferably have a volume average particle diameter of from 3 to 8 μm, more preferably from 3 to 7 μm, and most preferably from 4 to 7 μm. Additionally, the ratio of the volume average particle diameter to the number average particle diameter is preferably from 1.00 to 1.20, more preferably from 1.00 to 1.17, and most preferably from 1.00 to 1.15, within which the resulting toner can produce high quality images for an extended period of time without causing toner scattering or fogging.

Volume and number average particle diameters can be measured using an instrument COULTER COUNTER TA-II or COULTER MULTISIZER II (from Beckman Coulter).

The second liquid is prepared by dispersing the first liquid in the first aqueous medium including a dispersant by applying mechanical shearing force, for example. The toner components other than the binder resin and the precursor thereof may be added to the first aqueous medium when dispersing the first liquid therein, or alternatively, previously included in the first liquid. The latter is much better.

The first aqueous medium may be water or a mixture of water and a water-miscible organic solvent.

Specific examples of usable water-miscible organic solvents include, but are not limited to, alcohols (e.g., methanol, isopropyl alcohol, ethylene glycol), dimethylformamide, tetrahydrofuran, cellosolves (e.g., methyl cellosolve), and lower ketones (e.g., acetone, methyl ethyl ketone). Two or more of these solvents can be used in combination.

Specific preferred examples of suitable dispersants include, but are not limited to, anionic surfactants (e.g., alkylbenzene sulfonates, α-olefin sulfonates, phosphates), amine-salt-type cationic surfactants (e.g., alkylamine salts, amino alcohol fatty acid derivatives, polyamine fatty acid derivatives, imidazoline), quaternary-ammonium-salt-type cationic surfactants (e.g., alkyl trimethyl ammonium salts, dialkyl dimethyl ammonium salts, alkyl dimethyl benzyl ammonium salts, pyridinium salts, alkyl isoquinolinium salts, benzethonium chloride), nonionic surfactants (e.g., fatty acid amide derivatives, polyvalent alcohol derivatives), and ampholytic surfactants (e.g., alanine, dodecyl bis(aminoethyl)glycine, bis(octylaminoethyl)glycine, N-alkyl-N,N-dimethylammonium betain).

Surfactants having a fluoroalkyl group are also preferable. They are effective in small amounts.

Specific examples of anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid dimethanol amide, N-propyl-N-(2-hydroxyethyl) perfluorooctane sulfonamide, perfluoroalkyl(C6-C10) sulfonamide propyl trimethyl ammonium salts, perfluoroalkyl (C6-C10)-N-ethyl sulfonyl glycine salts, and monoperfluoroalkyl(C6-C16) ethyl phosphates. Two or more of these surfactants can be used in combination.

Specific examples of commercially available such anionic surfactants having a fluoroalkyl group include, but are not limited to, SURFLON® S-111, S-112, and S-113 (from AGC Seimi Chemical Co., Ltd.); FLUORAD™ FC-93, FC-95, FC-98, and FC-129 (from Sumitomo 3M); UNIDYNE™ DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

Specific examples of cationic surfactants having a fluoroalkyl group include, but are not limited to, aliphatic primary, secondary, and tertiary amine acids having a fluoroalkyl group; and aliphatic quaternary ammonium salts such as perfluoroalkyl(C6-C10) sulfonamide propyl trimethyl ammonium salts, benzalkonium salts, benzethonium chlorides, pyridinium salts, and imidazolinium salts. Two or more of these surfactants can be used in combination.

Specific examples of commercially available such cationic surfactants having a fluoroalkyl group include, but are not limited to, SURFLON® S-121 (from AGC Seimi Chemical Co., Ltd.); FLUORAD™ FC-135 (from Sumitomo 3M); UNIDYNE™ DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

The dispersant may further include resin particles and/or inorganic particles so that droplets of the first liquid do not coalesce with each other.

Specific preferred materials suitable for the resin particles include, but are not limited to, vinyl resins, polyurethane, epoxy resins, polyester, polyamide, polyimide, silicone resins, phenol resins, melamine resins, urea resins, aniline resins, ionomer resins, and polycarbonate resins. Two or more of these resins can be used in combination. Among these resins, vinyl resins, polyurethane, epoxy resins, and polyester are preferable because it is easy to obtain aqueous dispersions of fine spherical particles thereof.

Specific examples of usable vinyl resins include, but are not limited to, styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic copolymer, and styrene-methacrylic copolymer.

The resin particles preferably include a resin having a carboxyl group, more preferably a resin having an acrylic-acid-origin unit or a methacrylic-acid-origin unit, so that a charge controlling agent can be reliably fixed on their surfaces.

Specific preferred materials suitable for the inorganic particles include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. In particular, tricalcium phosphate, calcium carbonate, colloidal titanium oxide, colloidal silica, and hydroxyapatite are preferable. Specifically, a hydroxyapatite prepared by reacting sodium phosphate with calcium chloride in water under basic conditions is preferable.

In a case in which the dispersant includes acid-soluble or alkali-soluble materials, such as tricalcium phosphate, they can be removed by dissolving in an acid (e.g., hydrochloric acid) and successively washing with water.

Additionally, the dispersant may further include a polymeric protection colloid. Specific examples of usable polymeric protection colloids include, but are not limited to, homopolymers and copolymers obtained from monomers, such as monomers having a carboxyl group (e.g., acrylic acid, methacrylic acid, α-cyanoacrylic acid, α-cyanomethacrylic acid, itaconic acid, crotonic acid, fumaric acid, maleic acid, maleic anhydride), acrylate and methacrylate monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate, N-methylol acrylamide, N-methylol methacrylamide), vinyl alkyl ether monomers (e.g., vinyl methyl ether, vinyl ethyl ether, vinyl propyl ether), ester monomers of vinyl alcohols with carboxylic acids (e.g., vinyl acetate, vinyl propionate, vinyl butyrate), amide monomers (e.g., acrylamide, methacrylamide, diacetone acrylamide) and methylol compounds thereof, monomers having a chlorinated carbonyl group (e.g., acrylic acid chloride, methacrylic acid chloride), and/or monomers containing nitrogen atom or a nitrogen-containing heterocyclic ring (e.g., vinyl pyridine, vinyl pyrrolidone, vinyl imidazole, ethylene imine); polyoxyethylenes (e.g., polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, polyoxyethylene nonyl phenyl ester); and celluloses (e.g., methyl cellulose, hydroxyethyl cellulose, hydroxypropyl cellulose).

The primary particles are produced by removing the organic solvent from the second liquid. The organic solvent is removed from the second liquid by gradually heating the second liquid to evaporate the organic solvent, or spraying the second liquid into dry atmosphere to evaporate both the organic solvent and the first aqueous medium, for example.

The dry atmosphere may be, for example, a flow current of air, nitrogen gas, carbon dioxide gas, or combustion gas. Such flow currents are preferably heated to above the boiling point of the organic solvents or the first aqueous medium, which is highest.

The second liquid can be sprayed into the dry atmosphere by a spray drier, a belt drier, or a rotary kiln, for example.

The primary particles are washed to remove the dispersant therefrom. For example, the primary particles can be washed with water while filtering.

To more effectively remove the dispersant, the primary particles are preferably dispersed in water so that the resulting dispersion has a pH of from 3.0 to 6.0, and the dispersion is then subjected to filtering. When pH is too low, impurity may deposit. When pH is too high, it may be difficult to effectively remove the dispersant.

The third liquid is prepared by dispersing the washed primary particles in the second aqueous medium and heating the second aqueous medium while or after dispersing the washed primary particles therein. The second aqueous medium may be water or a mixture of water and a water-miscible organic solvent.

A charge controlling agent is added to the third liquid. Specific preferred examples of suitable charge controlling agent include, but are not limited to, nigrosine dyes, triphenylmethane dyes, chrome-containing metal complex dyes, molybdenum acid chelate pigments, rhodamine dyes, alkoxy amines, quaternary ammonium salts, alkylamides, phosphor and phosphor-containing compounds, tungsten and tungsten-containing compounds, fluorine-containing surfactants, metal salts of salicylic acid, metal salts of salicylic acid derivatives, copper phthalocyanine, perylene, quinacridone, azo pigments, and polymers having a functional group such as a sulfonic group, a carboxyl group, and a quaternary ammonium salt group.

Specific examples of commercially available charge controlling agents include, but are not limited to, BONTRON® N-03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenylmethane derivative), COPY CHARGE® NEG VP2036 and COPY CHARGE® NX VP434 (quaternary ammonium salts), which are manufactured by Hoechst AG; LRA-901, and LR-147 (boron complex), which are manufactured by Japan Carlit Co., Ltd.

Among the above charge controlling agents, quaternary ammonium salts having a fluoro group is preferable for uniformly fixing to the surfaces of the primary particles in the third liquid, because quaternary ammonium salts having a fluoro group have affinity for carboxyl groups and are soluble in water including an alcohol.

The quaternary ammonium salts having a fluoro group can be used in combination with metal-containing azo dyes.

One example of the quaternary ammonium salts having a fluoro group is represented by the following formula (1):

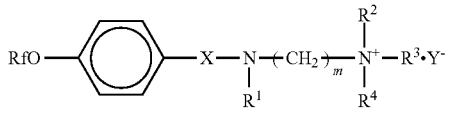

(1)

wherein Rf represents a perfluoroalkyl group; X represents a divalent organic group; each of $R^1$ to $R^4$ independently represents a hydrogen atom, a fluoro group, or a hydrocarbon group; $Y^-$ represents a counter ion; and m represents an integer of 1 or more.

Two or more of quaternary ammonium salts having a fluoro group can be used in combination.

In the formula (1), Rf preferably contains 3 to 60, more preferably 3 to 30, and most preferably 3 to 15 carbon atoms. Specific examples of Rf include, but are not limited to, $CF_3(CF_2)_5^-$, $CF_3(CF_2)_6^-$, $CF_3(CF_2)_7^-$, $CF_3(CF_2)_8^-$, $CF_3(CF_2)_9^-$, $CF_3(CF_2)_{10}^-$, $CF_3(CF_2)_{11}^-$, $CF_3(CF_2)_{12}^-$, $CF_3(CF_2)_{13}^-$, $CF_3(CF_2)_{14}^-$, $CF_3(CF_2)_{15}^-$, $CF_3(CF_2)_{16}^-$, $CF_3(CF_2)_{17}^-$ and $(CF_3)_2CF(CF_2)_6^-$.

In the formula (1), $Y^-$ may be, for example, a halide ion, a sulfate ion, a nitrate ion, a phosphate ion, a thiocyanate ion, or an organic acid ion. Preferably, $Y^-$ is a halide ion such as a fluoride ion, a chloride ion, a bromide ion, or an iodide ion.

In the formula (1), X may be, for example, $—SO_2—$, —CO—, $—(CH_2)_x—$, $SO_2N(R^5)—(CH_2)_x—$, or $—(CH_2)_x$ —CH(OH)—$(CH_2)_x$—, wherein x represents an integer of from 1 to 6 and $R^5$ represents an alkyl group having 1 to 10 carbon atoms. Among these groups, —$SO_2$—, —CO—$(CH_2)_2$—, $SO_2N(CH_2CH_5)$— $(CH_2)_2$—, and —$CH_2$—CH(OH)$CH_2^-$ are preferable, and —$SO_2$— and —CO— are more preferable.

In the formula (1), m is preferably a numeral between 1 and 20, and more preferably between 1 and 10.

In the formula (1), $R^1$, $R^2$, $R^3$, and/or $R^4$ may be a hydrocarbon group such as an alkyl group, an alkenyl group, and an aryl group. These groups may have a substituent.

Suitable alkyl group preferably contains 1 to 10 carbon atoms. Specific preferred examples of such alkyl groups include, but are not limited to, methyl group, ethyl group, n-propyl group, isopropyl group, n-butyl group, isobutyl group, sec-butyl group, n-hexyl group, isohexyl group, n-heptyl group, n-octyl group, isooctyl group, n-decyl group, and isodecyl group.

Suitable alkenyl group preferably contains 2 to 10 carbon atoms. Specific preferred examples of such alkenyl groups include, but are not limited to, vinyl group, allyl group, propenyl group, isopropenyl group, butenyl group, hexenyl group, and octenyl group.

Suitable aryl group preferably contains 6 to 24 carbon atoms. Specific preferred examples of such aryl groups include, but are not limited to, phenyl group, tolyl group, xylyl group, cumenyl group, styryl group, mesityl group, cinnamyl group, phenethyl group, and benzhydryl group.

The additive amount of the charge controlling agent in the third liquid is preferably from 0.1 to 10% by weight, more preferably from 0.2 to 5% by weight, based on the amount of the binder resin and/or the precursor thereof. When the additive amount of the charge controlling agent is too large, the resulting toner may generate too large an electrostatic attractive force between a developing roller, resulting in deterioration of fluidity of the toner and/or image density.

Toner particles are produced by adding the charge controlling agent to the third liquid. The toner particles are separated from the third liquid through the processes of filtering and drying. Thereafter, external additives, such as fluidizer or cleanability improver, may be further adhered to the surfaces of the toner particles.

Specific preferred examples of suitable fluidizers include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

The fluidizer preferably has a primary particle diameter of from 5 nm to 2 μm, and more preferably from 5 to 500 nm. The fluidizer preferably has a BET specific surface area of from 20 to 500 $m^2/g$.

The content of the fluidizer in the toner is preferably from 0.01 to 5% by weight, and more preferably from 0.01 to 2% by weight.

The fluidizer is preferably surface-treated so as to improve hydrophobicity. Specific preferred examples of usable surface treatment agents include, but are not limited to, silane-coupling agents, silylation agents, silane-coupling agents having a fluorinated alkyl group, organic titanate coupling agents, aluminum-based coupling agents, silicone oils, and modified silicone oils.

Specific preferred examples of suitable cleanability improvers include, but are not limited to, metal salts of fatty acids (e.g., zinc stearate, calcium stearate) and resin particles (e.g., polymethyl methacrylate, polystyrene).

The resin particles preferably have a narrow size distribution, and a volume average particle diameter of from 0.01 to 1 μm.

The external additives can be fixed to the surfaces of the toner particles by mixing the external additives and the toner particles upon application of mechanical impact.

Accordingly, the mixture may be agitated using high-speed rotating blades, or the mixture may be accelerated by a high-speed airflow to collide with a collision plate.

Specific preferred apparatuses suitable for applying mechanical impact include, but are not limited to, ONGMILL (from Hosokawa Micron Corporation), 1-type Mill (from Nippon Pneumatic Mfg. Co., Ltd.) which is modified so that the pressure of pulverizing air is reduced, HYBRIDIZATION SYSTEM (from Nara Machinery Co., Ltd.), KRYPTRON SYSTEM (from Kawasaki heavy Industries, Ltd.), and an automatic mortar.

The toner particles thus prepared can be mixed with carrier particles to be used as a two-component developer. The weight ratio of the toner particles to carrier particles in the two-component developer is preferably from 1 to 10%, more preferably from 3 to 9%.

The carrier particles may be, for example, powders of iron, ferrite, or magnetite, having a particle diameter of about 20 to 200 μm.

The carrier particles may have a covering layer comprising a resin on their surface. Specific preferred examples of suitable resins include, but are not limited to, amino resins (e.g., urea-formaldehyde resins, melamine resins, benzoguanamine resins, urea resins, polyamide resins, epoxy resins), polystyrene resins (e.g., acrylic resins, polymethyl methacrylate, polyacrylonitrile, polyvinyl acetate, polyvinyl alcohol, polyvinyl butyral, polystyrene, styrene-acrylic copolymer), halogenated olefin resins (e.g., polyvinyl chloride), polyvinyl and polyvinylidene resins (e.g., polyethylene, polyvinyl fluoride, polyvinylidene fluoride, polytrifluoroethylene, polyhexafluoropropylene, vinylidene-acrylic copolymer, vinylidene fluoride-vinyl fluoride copolymer, fluoroterpolymers such as tetrafluoroethylene-vinylidene fluoride-nonfluorinated monomer terpolymer), polyesters (e.g., polyethylene terephthalate, polybutylene terephthalate), polycarbonates, and silicone resins.

The covering layer may further include conductive powders. Specific examples of usable conductive powders include, but are not limited to, metal powders, carbon black, titanium oxide, tin oxide, and zinc oxide.

The conductive powders preferably have an average particle diameter of 1 μm or less. When the average particle diameter is too large, it is difficult to control electrical resistance of the covering layer.

Alternatively, the toner particles can be used as a one-component developer without mixed with carrier particles.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Polyester

A reaction vessel equipped with a condenser, a stirrer, and a nitrogen inlet pipe was charged with 690 parts of ethylene oxide 2 mol adduct of bisphenol A and 335 parts of terephthalic acid. The mixture was subjected to condensation reaction for 10 hours at 210° C. under normal pressures and nitrogen airflow, and successive 5 hours under reduced pressures of from 10 to 15 mmKg while dehydrating, followed by cooling. Thus, a polyester (1) having an acid value of 10 KOHmg/g was prepared.

Preparation of Prepolymer

A reaction vessel equipped with a condenser, a stirrer, and a nitrogen inlet pipe was charged with 795 parts of ethylene oxide 2 mol adduct of bisphenol A, 200 parts of isophthalic acid, 65 parts of terephthalic acid, and 2 parts of dibutyltin oxide. The mixture was subjected to condensation reaction for 8 hours at 210° C. under normal pressures and nitrogen airflow, and successive 5 hours under reduced pressures of from 10 to 15 mmKg while dehydrating, followed by cooling to 80° C. The reaction product was further reacted with 170 parts of isophorone diisocyanate for 2 hours in ethyl acetate. Thus, a prepolymer (1) was prepared.

Preparation of First Liquid

First, 170 parts of a 35% ethyl acetate dispersion of a carnauba wax, 120 parts of the polyester (1), 20 parts of a colorant PY155 (from Clariant), 70 parts of ethyl acetate, and 2 parts of isophorone diamine were contained in a tank, and mixed for 2 hours. The mixture was further circulated and mixed using a high-efficiency disperser EBARA MILDER (from Ebara Corporation) for 1 hour. Thus, a first liquid (1) having an acid value of 4.5 KOHmg/g was prepared.

Next, 25 parts of the prepolymer (1) and 25 parts of ethyl acetate were contained in another tank, and mixed for 4 hours. Thus, a first liquid (2) was prepared.

Preparation of Aqueous Medium

An aqueous medium (1) was prepared by mixing 945 parts of water, 40 parts of a 20% aqueous dispersion of a styrene-methacrylic acid-butyl acrylate copolymer, 160 parts of ELEMINOL MON-7 (from Sanyo Chemical Industries, Ltd.), i.e., a 50% aqueous solution of dodecyl diphenyl ether sodium disulfonate, and 90 parts of ethyl acetate in a tank.

Example 1

The first liquid (1), the first liquid (2), and the aqueous medium (1) were supplied to a T.K. PIPELINE HOMO MIXER (from Primix Corporation) at supply rates of 3,560 g/min, 440 g/min, and 6,000 g/min, respectively. Thus, a second liquid was prepared. The first liquid droplets in the second liquid had a volume average particle diameter of 5.9 μm, and the ratio of the volume average particle diameter to the number average particle diameter was 1.13.

The second liquid was then heated to 45° C. for 5 hours under an atmospheric pressure of 101.3 kPa, while being agitated with blades rotating at an outer peripheral speed of 10.5 m/sec, so that the organic solvents were removed and primary particles were produced. Thus, a slurry (1) was obtained.

The slurry (1) was pressure-filtered by a filter press, and then washed until the conductivity of the filtrate became 100 μS/cm. Thus, a filtered cake (1) was obtained.

The filtered cake (1) was dispersed in water using a DISPER MIXER so that the solid content concentration became 20%, and then mixed with 10% hydrochloric acid so that the pH became 4.0, followed by washing for 30 minutes. The wash liquid was pressure-filtered by a filter press, and then washed until the conductivity of the filtrate became 100 μS/cm. Thus, a filtered cake (2) was obtained.

The filtered cake (2) was dispersed in water using a DISPER MIXER so that the solid content concentration became 25%. Thus, a washed slurry (1) was obtained.

The washed slurry (1) was heated to 55° C. for 60 minutes by a heat exchanger and subsequently cooled to 25° C. Thus, a third liquid was prepared.

A part of the third liquid was filtered so that a part of the resultant primary particles were separated, and the separated primary particles were dried for 24 hours at 40° C. using a pressure reduction drier. The dried primary particles had a BET specific surface area (Sa) of 1.8 $m^2/g$.

The third liquid was mixed with water using a DISPER MIXER so that the solid content concentration became 20%, and further mixed with a 1% methanol solution of a charge controlling agent FTERGENT 310 from Neos Company Limited (i.e., N,N,N-trimethyl-[3-(4-perfluorononenyloxybenzamide)propyl]ammonium iodide) for 30 minutes to produce toner particles. Thus, a slurry (2) was prepared.

The slurry (2) was subjected to centrifugal separation, and the separated toner particles were dried for 24 hours at 40° C. using a pressure reduction drier.

A part of the dried toner particles were stored in a constant-temperature chamber at 40° C., 70% RH for 2 weeks. After the 2-week storage, the toner particles had a BET specific surface area (Sb) of 1.4 $m^2/g$.

Finally, 100 parts of the toner particles were mixed with 0.5 parts of a hydrophobized silica H2000 (from Clariant Japan K.K.) using a HENSCHEL MIXER, and further mixed with 0.5 parts of a hydrophobized silica H2000 (from Clariant Japan K.K.) and 0.5 parts of a hydrophobized titanium oxide MT150IB (from Tayca) using a HENSCHEL MIXER. The mixture was then sieved with a screen having openings of 37 μm to remove coarse particles. Thus, a toner (1-A) was obtained.

Example 2

The procedure in Example 1 was repeated except that the washed slurry (1) was heated to 45° C. for 120 minutes by a heat exchanger and subsequently cooled to 25° C. Thus, a toner (2-A) was obtained. The toner (2-A) had BET specific surface areas Sa and Sb of 1.9 $m^2/g$ and 1.3 $m^2/g$, respectively.

Example 3

The procedure in Example 1 was repeated except that the washed slurry (1) was heated to 65° C. for 20 minutes by a heat exchanger and subsequently cooled to 25° C. Thus, a toner (3-A) was obtained. The toner (3-A) had BET specific surface areas Sa and Sb of 1.6 $m^2/g$ and 1.5 $m^2/g$, respectively.

Example 4

The procedure in Example 1 was repeated except that the washed slurry (1) was heated to 70° C. for 20 minutes by a heat exchanger and subsequently cooled to 25° C. Thus, a toner (4-A) was obtained. The toner (4-A) had BET specific surface areas Sa and Sb of 1.5 $m^2/g$ and 1.5 $m^2/g$, respectively. The particles included in the washed slurry (1) were slightly adhered to the heat exchanger.

Example 5

The procedure in Example 1 was repeated except that the colorant PY155 (from Clariant) was replaced with another colorant PR1022 (deom DIC Corporation). Thus, a toner (5-A) was obtained. The toner (5-A) had BET specific surface areas Sa and Sb of 1.7 $m^2/g$ and 1.5 $m^2/g$, respectively.

Example 6

The procedure in Example 1 was repeated except that the washed slurry (1) was heated to 75° C. for 5 minutes by a heat exchanger and subsequently cooled to 25° C. Thus, a toner (6-A) was obtained. The toner (6-A) had BET specific surface areas Sa and Sb of 1.3 $m^2/g$ and 1.3 $m^2/g$, respectively. The particles included in the washed slurry (1) were adhered to the heat exchanger.

Comparative Example 1

The procedure in Example 1 was repeated except that the washed slurry (1) was heated to 35° C. for 600 minutes by a heat exchanger and subsequently cooled to 25° C. Thus, a toner (C1-A) was obtained. The toner (C1-A) had BET specific surface areas Sa and Sb of 2.4 $m^2/g$ and 1.4 $m^2/g$, respectively.

Comparative Example 2

The procedure in Example 1 was repeated except that the washed slurry (1) was heated to 30° C. for 600 minutes by a heat exchanger and subsequently cooled to 25° C. Thus, a toner (C2-A) was obtained. The toner (C2-A) had BET specific surface areas Sa and Sb of 4.5 $m^2/g$ and 1.5 $m^2/g$, respectively.

Comparative Example 3

The first liquid (1), the first liquid (2), and the aqueous medium (1) were supplied to a T.K. PIPELINE HOMO MIXER (from Primix Corporation) at supply rates of 3,560 g/min, 440 g/min, and 6,000 g/min, respectively. Thus, a second liquid was prepared. The first liquid droplets in the second liquid had a volume average particle diameter of 5.9 μm, and the ratio of the volume average particle diameter to the number average particle diameter was 1.13.

The second liquid was then heated to 45° C. for 5 hours under an atmospheric pressure of 101.3 kPa, while being agitated with blades rotating at an outer peripheral speed of 10.5 m/sec, so that the organic solvents were removed and primary particles were produced. Thus, a slurry (1) was obtained.

The slurry (1) was heated to 60° C. for 120 minutes by a heat exchanger and subsequently cooled to 25° C. Thus, a heated slurry (1) was obtained.

The heated slurry (1) was pressure-filtered by a filter press, and then washed until the conductivity of the filtrate became 100 μS/cm. Thus, a filtered cake (1) was obtained.

The filtered cake (1) was dispersed in water using a DISPER MIXER so that the solid content concentration became 20%, and then mixed with 10% hydrochloric acid so that the pH became 4.0, followed by washing for 30 minutes. The wash liquid was pressure-filtered by a filter press, and then washed until the conductivity of the filtrate became 100 μS/cm. Thus, a filtered cake (2) was obtained.

The filtered cake (2) was dispersed in water using a DISPER MIXER so that the solid content concentration became 25%. Thus, a third liquid was prepared.

The succeeding processes were the same as Example 1 expect for replacing the third liquid with the above-prepared one. Thus, a toner (C3-A) was prepared. The toner (C3-A) had BET specific surface areas Sa and Sb of 3.0 $m^2/g$ and 1.6 $m^2/g$, respectively.

Comparative Example 4

The first liquid (1), the first liquid (2), and the aqueous medium (1) were supplied to a T.K. PIPELINE HOMO MIXER (from Primix Corporation) at supply rates of 3,560 g/min, 440 g/min, and 6,000 g/min, respectively. Thus, a second liquid was prepared. The first liquid droplets in the second liquid had a volume average particle diameter of 5.9 μm, and the ratio of the volume average particle diameter to the number average particle diameter was 1.13.

The second liquid was then heated to 45° C. for 5 hours under an atmospheric pressure of 101.3 kPa, while being agitated with blades rotating at an outer peripheral speed of 10.5 m/sec, so that the organic solvents were removed and primary particles were produced. Thus, a slurry (1) was obtained.

The slurry (1) was pressure-filtered by a filter press, and then washed until the conductivity of the filtrate became 100 μS/cm. Thus, a filtered cake (1) was obtained.

The filtered cake (1) was dispersed in water using a DISPER MIXER so that the solid content concentration became 20%, and then mixed with 10% hydrochloric acid so that the pH became 4.0, followed by washing for 30 minutes. The wash liquid was pressure-filtered by a filter press, and then washed until the conductivity of the filtrate became 100 μS/cm. Thus, a filtered cake (2) was obtained.

The filtered cake (2) was dispersed in water using a DISPER MIXER so that the solid content concentration became 25%. Thus, a third liquid was prepared.

The third liquid was mixed with water using a DISPER MIXER so that the solid content concentration became 20%, and further mixed with a 1% methanol solution of a charge controlling agent FTERGENT 310 from Neos Company Limited (i.e., N,N,N-trimethyl-[3-(4-perfluorononenyloxybenzamide)propyl]ammonium iodide) for 30 minutes. Thus, a slurry (2) was prepared.

The slurry (2) was heated to 55° C. for 60 minutes by a heat exchanger to produce toner particles, and subsequently cooled to 25° C. Thus, a heated slurry (2) was obtained.

The heated slurry (2) was subjected to centrifugal separation, and the separated toner particles were dried for 24 hours at 40° C. using a pressure reduction drier.

The succeeding processes were the same as Example 1. Thus, a toner (C4-A) was prepared. The toner (C4-A) had BET specific surface areas Sa and Sb of 1.7 $m^2/g$ and 1.6 $m^2/g$, respectively.

The manufacturing conditions in Examples 1 to 6 and Comparative Examples 1 to 4 are summarized in Table 1.

TABLE 1

| | Conditions for Heating Third Liquid | | | | |
|---|---|---|---|---|---|
| | Temperature (° C.) | Time (min) | Sa ($m^2/g$) | Sb ($m^2/g$) | Sb/Sa |
| Example 1 | 55 | 60 | 1.8 | 1.4 | 0.78 |
| Example 2 | 45 | 120 | 1.9 | 1.3 | 0.68 |
| Example 3 | 65 | 20 | 1.6 | 1.5 | 0.94 |
| Example 4 | 70 | 15 | 1.5 | 1.5 | 1.00 |
| Example 5 | 55 | 60 | 1.7 | 1.5 | 0.88 |
| Example 6 | 75 | 5 | 1.3 | 1.3 | 1.00 |
| Comparative Example 1 | 35 | 600 | 2.4 | 1.4 | 0.58 |

TABLE 1-continued

| | Conditions for Heating Third Liquid | | | | |
|---|---|---|---|---|---|
| | Temperature (° C.) | Time (min) | Sa ($m^2/g$) | Sb ($m^2/g$) | Sb/Sa |
| Comparative Example 2 | 30 | 600 | 4.5 | 1.5 | 0.33 |
| Comparative Example 3 | 60 | 120 | 3.0 | 1.6 | 0.53 |
| Comparative Example 4 | 60 | 60 | 1.7 | 1.6 | 0.94 |

Measurement of BET Specific Surface Area

In the above Examples and Comparative Examples, BET specific surface area was measured as follows. A measurement cell was charged with 0.7 g of a sample and was degassed below 50 mmTorr by a degasser Vac Prep 061 (from Micromeritics Instrument Corporation). The cell was mounted on an instrument TriStar II3020 (from Micromeritics Instrument Corporation) to measure a nitrogen gas adsorption isotherm, from which BET specific surface area was determined. The adsorption isotherm was compiled from 6 data measured when a relative pressure of nitrogen gas was 0.05, 0.10, 0.15, 0.20, 0.25, and 0.30.

Preparation of Toners

In each Examples and Comparative Examples, 100 parts of the toner particles subjected to the measurement of Sb were mixed with 0.5 parts of a hydrophobized silica H2000 (from Clariant Japan K.K.) using a HENSCHEL MIXER, and further mixed with 0.5 parts of a hydrophobized silica H2000 (from Clariant Japan K.K.) and 0.5 parts of a hydrophobized titanium oxide MT150IB (from Tayca) using a HENSCHEL MIXER. The mixture was then sieved with a screen having openings of 37 μm to remove coarse particles. Thus, toners (1-B), (2-B), (3-B), (4-B), (5-B), (6-B), (C1-B), (C2-B), (C3-B), and (C4-B) are obtained.

Further, the above-prepared toners (1-A), (2-A), (3-A), (4-A), (5-A), (6-A), (C1-A), (C2-A), (C3-A), and (C4-A) were stored in a constant-temperature chamber at 40° C., 70% RH for 2 weeks. Thus, toners (1-C), (2-C), (3-C), (4-C), (5-C), (6-C), (C1-C), (C2-C), (C3-C), and (C4-C) were prepared, respectively.

(Toners named (X-A) were never stored in the constant-temperature chamber; toners named (X-B) were stored in the constant-temperature chamber at 40° C., 70% RH for 2 weeks before mixed with the hydrophobized silica H2000 and hydrophobized titanium oxide MT150IB; and toners named (X-C) were stored in the constant-temperature chamber at 40° C., 70% RH for 2 weeks after mixed with the hydrophobized silica H2000 and hydrophobized titanium oxide MT150IB.)

Preparation of Carrier

A toluene dispersion of an aminosilane coupling agent and a silicone resin was spray-coated on ferrite particles having an average particle diameter of 50 μm while heating, followed by calcining. Thus, a carrier, each particle having a covering layer having an average thickness of 0.2 μm, was prepared.

Evaluation of Chargeability

A stainless steel pot was charged with 100 parts of the carrier and 5 parts of each of the toners, and was subjected to a rolling treatment for 60 seconds at 300 rpm using a ball mill, to prepare each two-component developers. Each of the two-component developers was subjected to measurement of toner charge using a blow-off device. Chargeability of was graded as follows. $Q_A$, $Q_B$, and $Q_C$ represent the toner charges of the two-component developers including the toner (X-A), (X-B), and (X-C), respectively.

Good: The difference between $Q_A$ and $Q_s$ or $Q_c$ is less than 5 μC/g.

Poor: The difference between $Q_A$ and $Q_B$ or $Q_c$ is 5 μC/g or more.

The results are shown in Table 2.

TABLE 2

| | $Q_A$ (μC/g) | $Q_B$ (μC/g) | $Q_C$ (μC/g) | Chargeability |
|---|---|---|---|---|
| Example 1 | −35 | −34 | −35 | Good |
| Example 2 | −38 | −35 | −35 | Good |
| Example 3 | −37 | −37 | −36 | Good |
| Example 4 | −36 | −36 | −35 | Good |
| Example 5 | −43 | −41 | −40 | Good |
| Example 6 | −42 | −41 | −41 | Good |
| Comparative Example 1 | −40 | −34 | −34 | Poor |
| Comparative Example 2 | −46 | −40 | −37 | Poor |
| Comparative Example 3 | −45 | −39 | −36 | Poor |
| Comparative Example 4 | −29 | −28 | −29 | Poor |

The results shown in Table 2 indicate that the toners of Examples 1 to 6 do not degrade chargeability even after stored at 40° C., 70% RH for 2 weeks.

Additional modifications and variations of the present invention are possible in light of the above teachings. It is therefore to be understood that within the scope of the appended claims the invention may be practiced other than as specifically described herein.

What is claimed is:

1. A method of manufacturing toner, comprising:

preparing a first liquid by dissolving or dispersing toner components in an organic solvent, the toner components comprising one or both of a binder resin and a precursor thereof;

preparing a second liquid by dispersing the first liquid in a first aqueous medium comprising a dispersant;

producing primary particles by removing the organic solvent from the second liquid;

washing the primary particles;

preparing a third liquid by dispersing the washed primary particles in a second aqueous medium and heating the second aqueous medium while or after dispersing the washed primary particles therein; and producing toner particles by adding a charge controlling agent to the third liquid, wherein the following inequation is satisfied:

$$0.60 \leq Sb/Sa \leq 1.00$$

wherein Sa represents a BET specific surface area of the primary particles in the third liquid and Sb represents a BET specific surface area of the toner particles stored for 2 weeks at 40° C., 70% RH.

2. The method of manufacturing toner according to claim 1, wherein the second aqueous medium is heated at a temperature between 40 and 70° C. when preparing the third liquid.

3. The method of manufacturing toner according to claim 1, wherein the binder resin comprises a polyester.

4. The method of manufacturing toner according to claim 1, wherein the first liquid comprises a binder resin precursor which is a prepolymer, and the method further comprising reacting the prepolymer with a compound having an active hydrogen group while removing the organic solvent from the second liquid.

5. The method of manufacturing toner according to claim 1, further comprising mixing a fluidizer with the toner particles.

6. The method of manufacturing toner according to claim 1, wherein the following inequation is satisfied: $0.80 \leq Sb/Sa = 1.00$.

7. The method of manufacturing toner according to claim 1, wherein the charge controlling agent is a quaternary ammonium salt having a fluoro group.

8. The method of manufacturing toner according to claim 7, wherein the charge quaternary ammonium salt having a fluoro group is represented by the following formula (1):

(1)

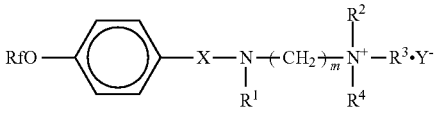

wherein Rf represents a perfluoroalkyl group having 30-60 carbon atoms; X is $—SO_2—$, $—CO—$, $—(CH_2)_x—$, $SO_2N(R^5)—(CH_2)_x—$, or $—(CH_2)_x—CH(OH)—(CH_2)_x—$, wherein x represents an integer of from 1 to 6 and $R^5$ represents an alkyl group having 1 to 10 carbon atoms; each of $R^1$ to $R^4$ independently represents a hydrogen atom, a fluoro group, or a hydrocarbon group; Y' is a halide ion, a sulfate ion, a nitrate ion, a phosphate ion, or a thiocyanate ion; and m represents an integer of 1-20.

9. The method of manufacturing toner according to claim 1, comprising adding 0.1 to 10% by weight charge controlling agent, based on the amount of the binder resin and/or precursor thereof, to the third liquid.

10. The method of manufacturing toner according to claim 7, comprising adding 0.1 to 10% by weight charge controlling agent, based on the amount of the binder resin and/or precursor thereof, to the third liquid.

11. The method of manufacturing toner according to claim 8, comprising adding 0.1 to 10% by weight charge controlling agent, based on the amount of the binder resin and/or precursor thereof, to the third liquid.

* * * * *